US010336105B2

(12) United States Patent
Sakai et al.

(10) Patent No.: US 10,336,105 B2
(45) Date of Patent: Jul. 2, 2019

(54) PRINTING APPARATUS

(71) Applicant: SEIKO EPSON CORPORATION, Tokyo (JP)

(72) Inventors: Mayu Sakai, Matsumoto (JP); Junya Kato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/446,034

(22) Filed: Mar. 1, 2017

(65) Prior Publication Data

US 2017/0253056 A1 Sep. 7, 2017

(30) Foreign Application Priority Data

Mar. 1, 2016 (JP) ..... 2016-038651

(51) Int. Cl.

| | |
|---|---|
| ***B41J 11/70*** | (2006.01) |
| ***B41J 15/04*** | (2006.01) |
| ***B41J 15/16*** | (2006.01) |
| ***B65H 19/26*** | (2006.01) |
| ***B41J 11/00*** | (2006.01) |

(52) U.S. Cl.

CPC ..... *B41J 11/70* (2013.01); *B41J 11/0085* (2013.01); *B41J 15/046* (2013.01); *B41J 15/16* (2013.01); *B65H 19/265* (2013.01)

(58) Field of Classification Search

CPC ..... B41J 11/70; B41J 15/046; B41J 15/16; B65H 19/265

See application file for complete search history.

(56) References Cited

U.S. PATENT DOCUMENTS

| | | | | |
|---|---|---|---|---|
| 5,600,900 | A * | 2/1997 | Marschke | F26B 13/105 34/519 |
| 6,302,602 | B1 * | 10/2001 | Kiyohara | B26D 1/045 400/593 |
| 2011/0026998 | A1 * | 2/2011 | Doo | B41J 11/002 400/621 |
| 2012/0236100 | A1 * | 9/2012 | Toya | B41J 11/0085 347/104 |
| 2013/0277482 | A1 * | 10/2013 | Naramatsu | B65H 23/063 242/334 |
| 2014/0063163 | A1 * | 3/2014 | Kanemoto | B65H 23/0326 347/104 |
| 2014/0198147 | A1 * | 7/2014 | Sasaki | B41J 11/0015 347/16 |
| 2014/0218423 | A1 * | 8/2014 | Sasaki | B65H 23/02 346/136 |

FOREIGN PATENT DOCUMENTS

JP 2000-190481 A 7/2000

* cited by examiner

*Primary Examiner* — Kristal Feggins
*Assistant Examiner* — Kendrick X Liu
(74) *Attorney, Agent, or Firm* — Workman Nydegger

(57) ABSTRACT

A printing apparatus includes a printing unit that prints on a medium, and a downstream side support unit that is disposed on a downstream side in a transport direction of the medium with respect to the printing unit and includes a heater which heats the medium and suction holes which is communicated with suction mechanisms. In a case of cutting the medium, the suction mechanisms are driven so that the medium is sucked and supported by the downstream side support unit via the suction holes.

6 Claims, 5 Drawing Sheets

PRINTING APPARATUS

BACKGROUND

1. Technical Field

The present invention relates to a printing apparatus.

2. Related Art

For example, an ink jet (printing apparatus) using roll papers as media is proposed (JP-A-2000-190481).

The printing apparatus according to JP-A-2000-190481 includes transport means that transports the medium, printing means that ejects ink droplets, a suction fan that sucks the medium disposed on a platen via the suction hole, a cutter that cuts the medium, and control means, repeats an operation of transporting the medium and an operation of ejecting the ink droplets, and prints on the medium.

In the printing apparatus, the suction holes are disposed on both of an upstream side and a downstream side with respect to a cut position of the medium. In other words, the suction holes are disposed on both of a portion for ejecting the ink droplets and a portion for drying ink. While printing on the medium, cutting the medium, and drying the ink ejected on the medium, the suction fan operates, and the medium is sucked into both the portion for ejecting the ink droplets and the portion for drying the ink.

With such a configuration, it is supposed that the possibility in which the ink is ejected without being dried and an undried image is contaminated is suppressed.

In a case of printing on the medium in the printing apparatus according to JP-A-2000-190481, the medium is sucked in both of the suction hole disposed in the portion for ejecting the ink droplets and the suction hole disposed in the portion for drying the ink. Accordingly, since the medium is strongly sucked (constrained) as compared with a case of being sucked only by the suction hole disposed in the portion for ejecting the ink droplets, a load on the transport means for transporting the medium becomes heavier, and the transport failure of the medium is likely to occur. Therefore, in a case where an operation of transporting the medium and an operation of ejecting the ink droplets are repeated and the medium is printed, printing trouble caused by transport failure of the medium is likely to occur.

Otherwise, when the suction hole is disposed in the portion for drying the ink, since the portion in contact with the suction hole of the medium is unlikely to be heated, a heating temperature of the medium is different between the portion in contact with the suction hole of the medium and the portion not in contact with the suction hole of the medium (portion in contact with the platen). Therefore, drying unevenness is likely to occur in the ink ejected on the medium.

SUMMARY

An advantage of some aspects of the invention can be realized as the following aspects or application examples.

Application Example 1

According to this application example, there is provided a printing apparatus including a printing unit that prints on a medium, and a medium support unit that is disposed on a downstream side in a transport direction of the medium with respect to the printing unit, and includes a heater which heats the medium and an opening portion which is communicated with a suction mechanism. In a case of cutting the medium, the suction mechanism is driven so that the medium is sucked and supported by the medium support unit via the opening portion.

Since the medium support unit is disposed on the downstream side in the transport direction of the medium with respect to the printing unit, and includes the heater for heating the medium, the medium support unit corresponds to a portion for drying the medium. The opening portion communicating with the suction mechanism is disposed in the portion for drying the medium. In a case of cutting the medium, since the suction mechanism is driven and the medium is sucked and supported by the medium support unit (portion for drying the medium), it is possible to make it difficult to cause trouble that the cut medium falls in the gravity direction due to own weight and is contaminated.

Furthermore, the suction mechanism sucks the portion for drying the medium, and does not affect the portion (portion where ink droplets are ejected) to be printed on the medium. Accordingly, in a case of printing on a medium, since it is possible to suck only the portion (portion where ink droplets are ejected) to be printed on the medium without sucking the portion for drying the medium, as compared with a case of sucking both of the portion (portion where ink droplets are ejected) to be printed on the medium and the portion for drying the medium, load of transport means for transporting the medium is lightened, and transport failure of the medium is unlikely to occur. Accordingly, in a case of printing on a medium, printing troubles caused by the transport failure of the medium is unlikely to occur.

Application Example 2

In the printing apparatus according to the application example, it is preferable that the printing apparatus further include a winding portion that is disposed on the downstream side with respect to the medium support unit, and winds up the medium, and in a case of winding up the cut medium around the winding portion, the suction mechanism be driven so that the medium is sucked and supported by the medium support unit via the opening portion.

In a case of winding up the cut medium around the winding portion, since the medium is sucked and supported by the portion (medium support unit) for drying the medium, it is possible to make it difficult to cause trouble that the medium falls in the gravity direction due to own weight and is contaminated.

Application Example 3

In the printing apparatus according to the application example, it is preferable that the printing apparatus further include a tension applying unit that is disposed between the medium support unit and the winding portion, the tension applying unit include a tension bar that applies tension to the medium, and in a case of cutting the medium, the tension bar be moved so that tension applied from the tension bar is reduced.

In a case of cutting the medium, when large tension is applied to the medium, since the medium deforms in a direction to which tension is applied, it is difficult to suck and support the medium by the medium support unit (portion for drying the medium), and the trouble that the cut medium falls in the gravity direction due to own weight and is contaminated is likely to occur. In the application example, in the case of cutting the medium, since tension applied from the tension bar is reduced, the medium is unlikely to be deformed in the direction to which the tension is applied, and it is easy to suck and support the medium on the medium support unit (portion for drying the medium). Therefore, the trouble that the cut medium falls in the gravity direction due to own weight and is contaminated is unlikely to occur.

Application Example 4

In the printing apparatus according to the application example, it is preferable that the opening portion be disposed on an upstream side in the transport direction of the medium with respect to the heater in the medium support unit.

For example, when the opening portion for sucking the medium and the heater for heating the medium are disposed in the same region, there is a possibility that a temperature difference is generated between the portion in contact with the opening portion of the medium and the portion in contact with the medium support unit of the medium so that the medium cannot be uniformly heated. In the application example, since the opening portion for sucking the medium and the heater for heating the medium are disposed in different regions, as compared with a case where the opening portion for sucking the medium and the heater for heating the medium are disposed in the same region, it is possible to uniformly heat the medium.

Furthermore, when the medium is cut on the side far from the printing unit, as compared with a case of cutting the medium on the side close to the printing unit, since waste is likely to occur in the printed medium, it is preferable to cut the medium on the side close to the printing unit. It is preferable that the opening portion for sucking and supporting the medium on the medium support unit be disposed on the side close to the printing unit. Accordingly, it is preferable that the opening portion for sucking and supporting the medium on the medium support unit be disposed on the upstream side in the transport direction of the medium with respect to the heater.

Application Example 5

In the printing apparatus according to the application example, it is preferable that the opening portion be disposed on the downstream side with respect to the heater in the medium support unit.

For example, when the opening portion for sucking the medium and the heater for heating the medium are disposed in the same region, there is a possibility that a temperature difference is generated between the portion in contact with the opening portion of the medium and the portion in contact with the medium support unit of the medium so that the medium cannot be uniformly heated. In the application example, since the opening portion for sucking the medium and the heater for heating the medium are disposed in different regions, as compared with a case where the opening portion for sucking the medium and the heater for heating the medium are disposed in the same region, it is possible to uniformly heat the medium.

Furthermore, in a case of winding up the medium around the winding portion, when the medium is sucked and supported by the medium support unit on the side close to the winding portion, as compared with a case where the medium is sucked and supported by the medium support unit on the side far from the winding portion, since the area of the medium which is not sucked and supported by the medium support unit can be narrowed, adverse effects (for example, stain of the medium) that the medium which is not sucked and supported by the medium support unit falls in the gravity direction due to own weight can be reduced. Accordingly, it is preferable that the opening portion for sucking and supporting the medium on the medium support unit be disposed on the side close to the winding portion, that is, on the downstream side in the transport direction of the medium with respect to the heater.

Application Example 6

In the printing apparatus according to the application example, it is preferable that the opening portion be a hole that penetrate the medium support unit, the medium support unit include a hole column that is disposed in a direction in which the hole intersects the transport direction, and a position in the transport direction of the hole, and a position in the transport direction of the hole adjacent to the hole be different from each other in the hole column.

In the hole column, a plurality of holes are disposed so that the position in the transport direction of the hole and the position in the transport direction of the hole adjacent to the hole are different from each other. That is, in the hole column, the holes are disposed in a zigzag shape. When the holes are disposed in a zigzag shape, for example, as compared with a case where the holes are disposed in a latticed shape, it is possible to increase the arrangement density of the holes, to uniformly arrange the holes, and to stably suck the medium.

Application Example 7

In the printing apparatus according to the application example, it is preferable that the opening portion penetrate the medium support unit, and be a groove that extends in a direction intersecting the transport direction.

When the opening portion is a groove extending in a direction intersecting the transport direction, as compared with a case where the opening portion is scattered in the direction intersecting the transport direction, the area of the portion for sucking the medium is increased, and it is possible to strongly suck the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings. The embodiment illustrates one aspect of the invention, and without being limited to the invention, can be arbitrarily changed within the scope of a technical idea of the invention. In addition, in the following drawings, in order to make sizes of each layer and each portion be recognizable sizes on the drawings, a scale of each layer and each portion is made different from an actual scale.

Embodiment

Outline of a Printing Apparatus

Figure 1:
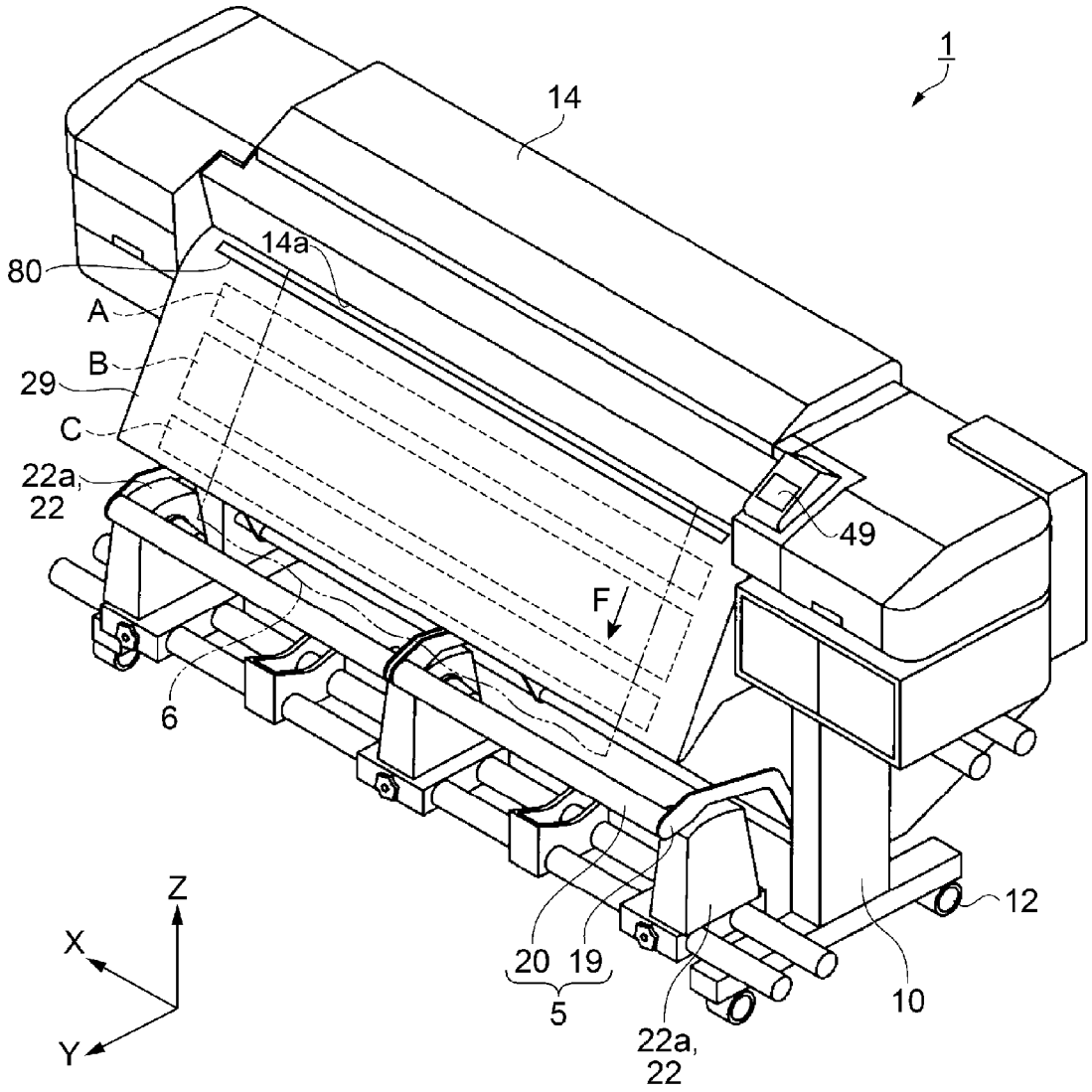
FIG. 1 is a perspective view of a printing apparatus according to an embodiment.
Figure 2:
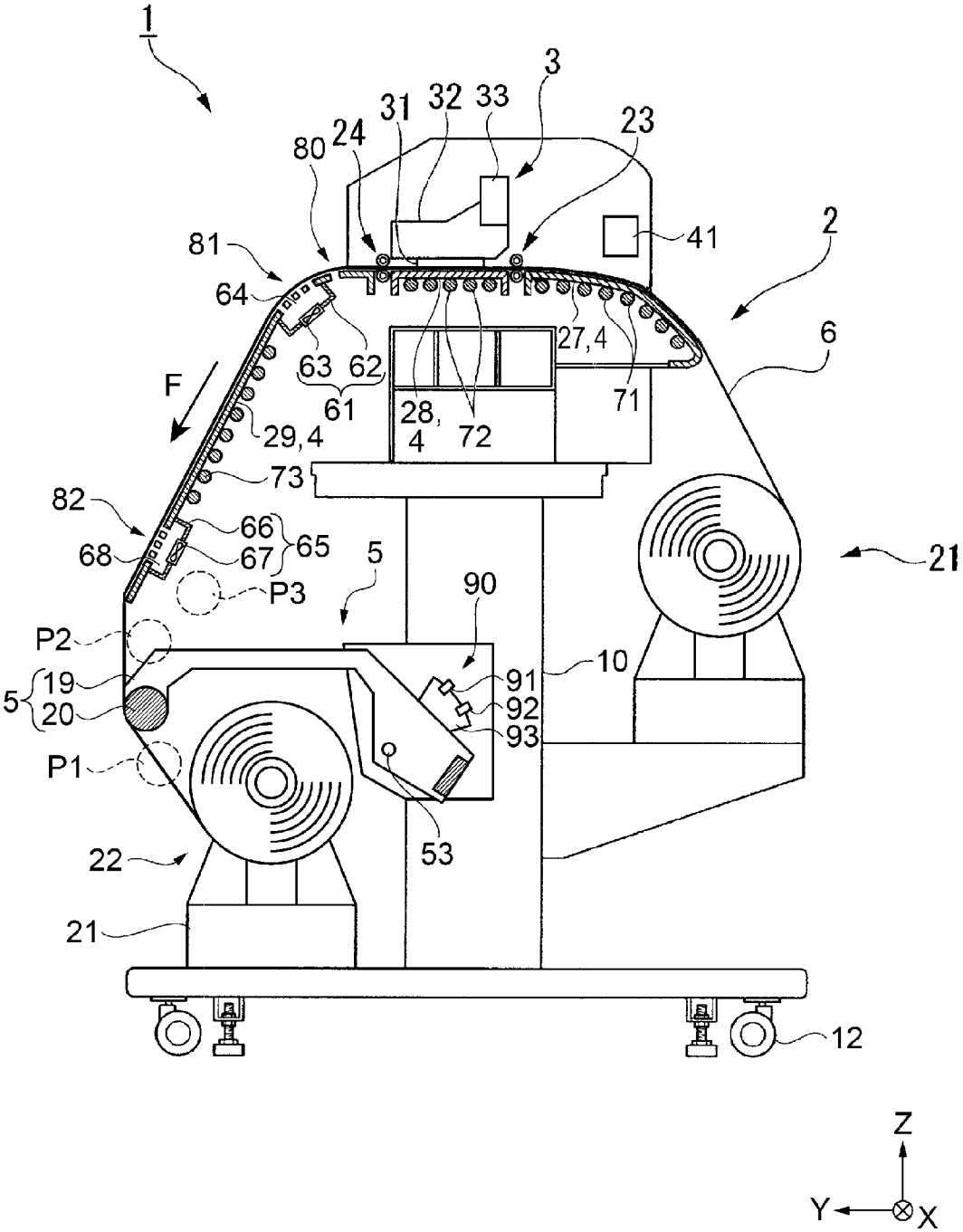
FIG. 2 is a schematic diagram illustrating a schematic configuration of the printing apparatus according to the embodiment.
Figure 3:
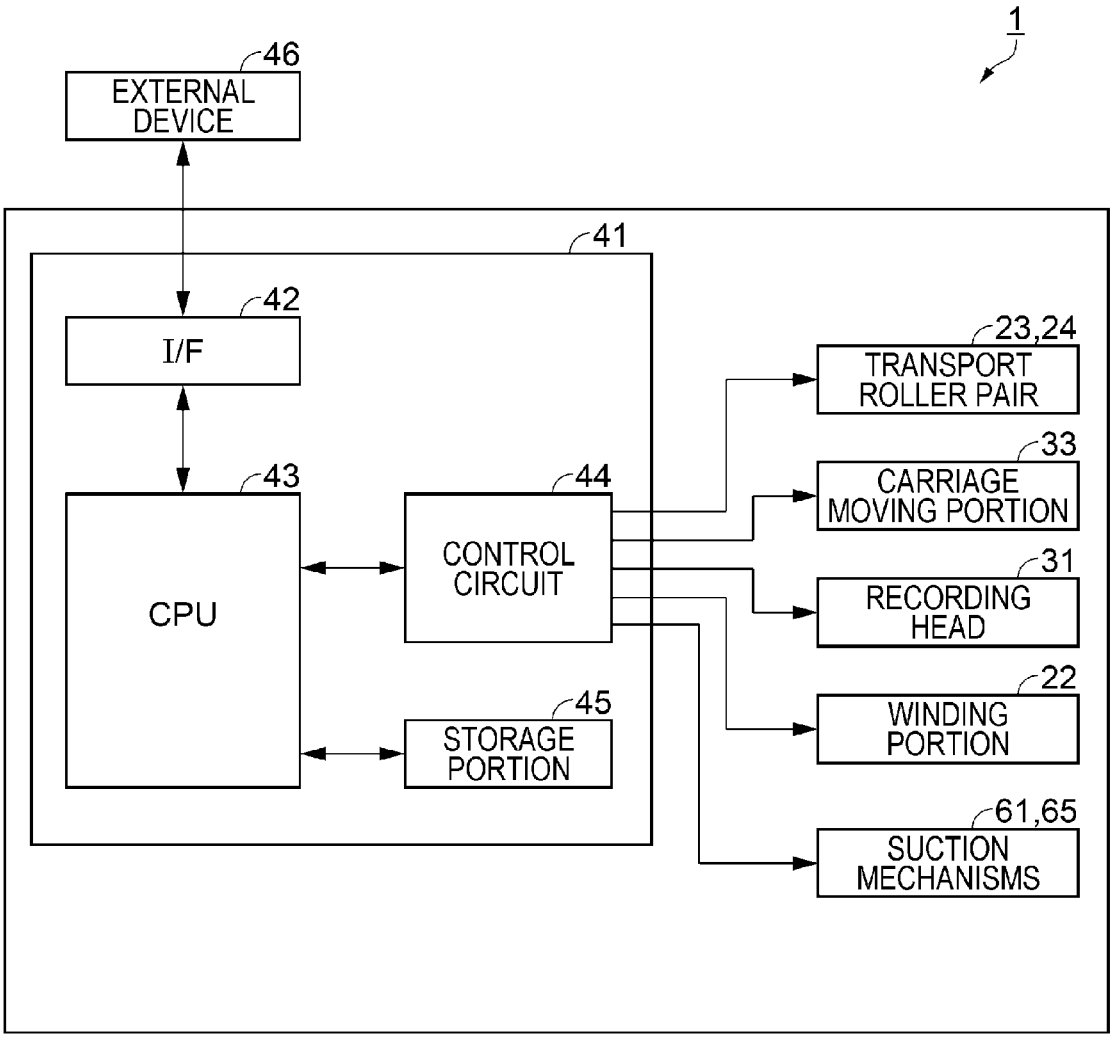
FIG. 3 is a block diagram illustrating an electric configuration of the printing apparatus according to the embodiment.

FIG. 1 is a perspective view of a printing apparatus according to an embodiment. FIG. 2 is a schematic diagram illustrating a schematic configuration of the printing apparatus according to the embodiment. FIG. 3 is a block diagram illustrating an electric configuration of the printing apparatus according to the embodiment.

First, the outline of the printing apparatus 1 will be described with reference to FIGS. 1 to 3.

As illustrated in FIG. 1, the printing apparatus 1 according to the embodiment is a large format printer (LFP) that handles relatively large media.

The printing apparatus 1 includes a body frame 10 on which a wheel 12 is attached to a lower end, and a casing portion 14 assembled to the body frame 10. A feeding portion 21 (refer to FIG. 2) for feeding a medium 6 toward the casing portion 14 side is disposed on a rear lower side of the casing portion 14. On the front lower side of the casing portion 14, a winding portion 22 supported by the main body frame 10 and for winding up the medium 6 is disposed. A downstream side support unit 29 is disposed between the casing portion 14 and the winding portion 22 along a transport path of the medium 6. In the downstream side support unit 29, a rear end side is accommodated in the casing portion 14 and a front end side protrudes forward from the casing portion 14. In addition, a discharge port 14*a* for discharging the medium 6 from the inside of the casing portion 14 is formed at a position where is the upper side of the downstream side support unit 29, on the front side of the casing portion 14. The medium 6 is configured of, for example, cloth such as polyester, paper, film, and the like.

The downstream side support unit 29 is an example of a "medium support unit".

The winding portion 22 is disposed on a downstream side in a transport direction F with respect to the downstream side support unit 29 and includes a pair of holders 22*a* that clamps a core material (for example, paper tube, not illustrated) from both sides in the axial direction, for winding up the printed medium 6 in a cylindrical shape. Furthermore, between the downstream side support unit 29 and the winding portion 22, a tension applying unit 5 for applying tension (tensile strength) to the medium 6 is disposed.

A control unit 41 (refer to FIG. 2) for controlling the operation of the printing apparatus 1 is disposed in the casing portion 14. On the upper portion of the casing portion 14, an operation panel 49 for performing a setting operation and an input operation is disposed on a first end side (right end side in FIG. 1) of the casing portion 14 in a longitudinal direction. The operation panel 49 is electrically connected to the control unit 41.

The downstream side support unit 29 is disposed between a printing unit 3 (refer to FIG. 2) and the winding portion 22, and supports the medium 6 sent out from the printing unit 3. The downstream side support unit 29 includes a guide portion 80, a region A where an upstream side suction hole 81 (refer to FIG. 2) is disposed, a region B where a third heater 73 (refer to FIG. 2) is disposed, and a region C where a downstream side suction hole 82 (refer to FIG. 2) is disposed, along the transport direction F of the medium 6.

The regions A, B, and C are indicated by broken lines in the drawings.

The guide portion 80 is an opening (groove) penetrating the downstream side support unit 29. The guide portion 80 includes a shape extending in a cutting direction of the medium 6. A user moves a cutting member such as a cutter along the guide portion 80 and cuts the medium 6. That is, a portion where the guide portion 80 is disposed is a cutting position (cutting position) of the medium 6.

The guide portion 80 may be a recessed portion disposed in the downstream side support unit 29, instead of the opening penetrating the downstream side support unit 29.

Hereinafter, a direction along a gravity direction is set to be a Z direction, a longitudinal direction of the casing portion 14 is set to be a X direction, and a direction intersecting (orthogonal to) both of the Z direction and the X direction is set to be a Y direction. Furthermore, a tip end side of an arrow indicating the direction in the drawings is set to be "+ side" and the bottom end side is set to be "– side".

The feeding portion 21, the downstream side support unit 29, the tension applying unit 5, and the winding portion 22 are disposed in order along the transport direction F. That is, the winding portion 22 is disposed on the downstream side in the transport direction F with respect to the downstream side support unit 29. The tension applying unit 5 is disposed between the downstream side support unit 29 and the winding portion 22.

As illustrated in FIG. 2, the printing apparatus 1 includes a transport unit 2 for transporting the medium 6 in a roll-to-roll system, the printing unit 3 for ejecting (discharging) ink and printing images and characters on the medium 6, a support unit 4 for supporting the medium 6, the tension applying unit 5, and the control unit 41 for controlling the operation of each of these components. Each of these components is supported by the body frame 10.

The transport unit 2 includes the feeding portion 21 for feeding out the medium 6 with a roll shape to the printing unit 3, and the winding portion 22 for winding up the medium 6 delivered from the printing unit 3. Furthermore, the transport unit 2 includes the transport roller pairs 23 and 24 as a transport roller for transporting the medium 6 in the transport path between the feeding portion 21 and the winding portion 22. The transport roller pair 23 is disposed in the transport path between the feeding portion 21 and the printing unit 3, and the transport roller pair 24 is disposed in the transport path between the printing unit 3 and the winding portion 22.

In the embodiment, although the printing apparatus 1 having two transport roller pairs 23 and 24 is exemplified, a configuration thereof may have a single transport roller pair, or a configuration thereof may have three or more the transport roller pairs.

In the feeding portion 21, a roll body in which an unused medium 6 is wound in the cylindrical shape is held. In the feeding portion 21, rolls of a plurality of sizes different in the width (length in the X direction) and the number of turns of the medium 6 are loaded to be exchangeable. The roll body is loaded in the feeding portion 21 in a state of being brought close to the first end side (right end side in FIG. 1) in the X (–) direction regardless of the size. That is, in the printing apparatus 1, an alignment reference position of the medium 6 is set on the first end side in the X (–) direction. As the feeding portion 21 rotates the roll body in a counterclockwise direction, the medium 6 is unwound from the roll body and fed to the printing unit 3.

In the winding portion 22, the roll body in which the medium 6 printed by the printing unit 3 is wound up in the cylindrical shape is held. The winding portion 22 includes a pair of holders 22*a* that interposes the core material for winding up the medium 6 to form the roll body. A winding motor (not illustrated) for supplying rotational power to the core material is provided in one of the holders 22*a*. As the winding motor is driven and the core material rotates, the medium 6 is wound around the core material to form the roll body.

The printing unit 3 includes a recording head 31 capable of ejecting the ink toward the medium 6, a carriage 32 on which the recording head 31 is mounted, and a carriage moving portion 33 for reciprocating the carriage 32 in a direction (X direction) intersecting the transport direction F. The recording head 31 includes a plurality of nozzles and is configured so as to be able to eject the ink which is selected in relation to the medium 6 and which requires penetration drying and evaporation drying.

In the printing apparatus 1, an operation of ejecting ink from the recording head 31 to the medium 6 while the printing unit 3 reciprocates the carriage 32 in the X direction, and an operation of transporting the medium 6 in the transport direction F by the transport unit 2 are alternately repeated. Therefore, images, characters, and the like can be printed on the medium 6.

The support unit 4 is a member for supporting the medium 6 in the transport path of the medium 6, and includes an upstream side support unit 27, a platen 28, and the downstream side support unit 29. The upstream side support unit 27 is disposed between the feeding portion 21 and the transport roller pair 23. The platen 28 is disposed facing the printing unit 3, and is disposed between the transport roller pair 23 and the transport roller pair 24. The downstream side support unit 29 is disposed between the transport roller pair 24 and the winding portion 22.

The upstream side support unit 27 supports the medium 6 sent out from the feeding portion 21 and guides the medium 6 to the side of the printing unit 3.

The platen 28 is provided with a substantially rectangular surface whose longitudinal direction is the width direction (X direction) of the medium 6 on the upper surface facing the recording head 31. Furthermore, a suction mechanism (not illustrated) for forming a negative pressure is attached to the platen 28. The platen 28 includes a suction hole (not illustrated) communicating with the suction mechanism, and drives the suction mechanism so that the medium 6 is sucked and supported by the platen 28 via the suction hole.

During printing by the printing unit 3, the suction mechanism is driven so that the medium 6 is sucked and supported by the platen 28 via the suction hole. Thereby, floating of the medium 6 is suppressed, an interval between the recording head 31 and the medium 6 is maintained uniform, and the ink ejected from the recording head 31 accurately lands at a predetermined position of the medium 6. Therefore, the quality of the image printed on the medium 6 is enhanced.

In addition, in a case where the printing on the medium 6 is completed, for example, in a case of cutting the medium 6, the suction mechanism is stopped and the medium 6 is not sucked and supported by the platen 28.

The downstream side support unit 29 supports the medium 6 printed by the printing unit 3 and sent out from the printing unit 3 and guides the medium 6 to the winding portion 22 side. Although details will be described later, the downstream side support unit 29 includes the suction holes 81 and 82 communicating with the suction mechanisms 61 and 65 which form the negative pressure, and is configured so that the medium 6 is sucked and supported by the downstream side support unit 29 via the suction holes 81 and 82, by driving the suction mechanisms 61 and 65.

The upstream side support unit 27, the platen 28, and the downstream side support unit 29 respectively include heaters 71, 72, and 73 for heating the medium 6. Specifically, the upstream side support unit 27 includes a first heater (preheater) 71, the platen 28 includes a second heater (platen heater) 72, and the downstream side support unit 29 includes a third heater (after-heater) 73. The first heater 71 is disposed on an upstream side in the transport direction F with respect to the printing unit 3. The third heater 73 is disposed on a downstream side in the transport direction F with respect to the printing unit 3.

The third heater 73 is an example of a "heater".

The first heater 71 heats the medium 6 on the upstream side in the transport direction F from the position where the printing unit 3 is disposed. The first heater 71 is attached to the surface opposite to the surface supporting the medium 6 in the upstream side support unit 27.

The second heater 72 heats the medium 6 in the printing unit 3. The second heater 72 is attached to the surface opposite to the surface supporting the medium 6 in the platen 28.

The third heater 73 heats the medium 6 on the downstream side in the transport direction F from the position where the printing unit 3 is disposed. The third heater 73 is attached to the surface opposite to the surface supporting the medium 6 in the downstream side support unit 29.

The heaters 71, 72, and 73 are, for example, tube heaters, and are respectively attached to the upstream side support unit 27, the platen 28 and the downstream side support unit 29 via an aluminum tape or the like. By driving the heaters 71, 72, and 73, the surface supporting the medium 6 in the support unit 4 by heat conduction is heated, and the medium 6 can be heated from the back side of the medium 6.

For example, the heating temperature of the first heater 71 is set to approximately 40° C., the heating temperature of the second heater 72 is set to 40° C. (target temperature), and the heating temperature of the third heater 73 is set to 50° C. higher than that of the first heater 71 and the second heater 72.

The first heater 71 gradually raises the temperature of the medium 6 from a room temperature toward the target temperature (heating temperature of the second heater 72), thereby the drying from a landing of the ink rapidly proceeds.

The second heater 72 lands the ink on the medium 6 in a state where the target temperature is maintained, and rapidly proceeds the drying from the landing of the ink.

The third heater 73 raises the temperature of the medium 6 to a temperature higher than the target temperature, rapidly dries the ink landed on the medium 6, and before winding up the medium 6 at least around the winding portion 22, causes the landed ink to be completely dried and fixed on the medium 6. Specifically, a uniformity of the heating temperature by the third heater 73 is likely to affect the quality of the image. If the heating temperature by the third heater 73 becomes uneven, spreading and blurring are likely to occur, and there is a possibility that the quality (image quality) of the image printed on the medium 6 deteriorates.

Furthermore, in the downstream side support unit 29, the guide portion 80, the upstream side suction hole 81, the third heater 73, and the downstream side suction hole 82 are disposed in order along the transport direction F. That is, the guide portion 80, the upstream side suction hole 81, the third heater 73, and the downstream side suction hole 82 are disposed on the downstream side in the transport direction F with respect to the printing unit 3.

The upstream side suction hole 81 and the downstream side suction hole 82 are an example of an "opening portion".

As described above, the guide portion 80 is the opening (groove) penetrating the downstream side support unit 29, and is disposed at the cutting position of the medium 6. The portion where the guide portion 80 is disposed, specifically, the portion where the guide portion 80 and the medium 6 overlap is the cutting position (cut position) of the medium 6.

The upstream side suction hole 81 is the hole penetrating the downstream side support unit 29, and is disposed in the region A of the downstream side support unit 29. The upstream side suction hole 81 is disposed on the downstream side in the transport direction F with respect to the guide portion 80, and is disposed on the upstream side in the transport direction F with respect to the third heater 73.

The downstream side suction hole 82 is the hole penetrating the downstream side support unit 29, and is disposed in the region C of the downstream side support unit 29. The downstream side suction hole 82 is disposed on the downstream side in the transport direction F with respect to the guide portion 80, and is disposed on the downstream side in the transport direction F with respect to the third heater 73.

The third heater 73 is disposed between the region B of the downstream side support unit 29, that is, the upstream side suction hole 81 and the downstream side suction hole 82. The region B of the downstream side support unit 29 on which the third heater 73 is disposed heats the medium 6 and becomes a region for drying the ink ejected on the medium 6.

Furthermore, the suction mechanisms 61 and 65 are attached to the surface opposite to the surface supporting the medium 6 of the downstream side support unit 29. The suction mechanism 61 is attached to the region A of the downstream side support unit 29, and the suction mechanism 65 is attached to the region C of the downstream side support unit 29. The upstream side suction hole 81 communicates with the suction mechanism 61, and the downstream side suction hole 82 communicates with the suction mechanism 65.

The suction mechanism 61 includes a negative pressure chamber forming member 62 and an exhaust fan 63. The negative pressure chamber forming member 62 forms a negative pressure chamber 64 between the negative pressure chamber forming member 62 and the downstream side support units 29. The exhaust fan 63 is attached to the negative pressure chamber forming member 62, and discharges the air in the negative pressure chamber 64 to the outside. That is, when the exhaust fan 63 is driven, the air in the negative pressure chamber 64 is discharged to the outside, and the pressure of the negative pressure chamber 64 becomes a negative pressure. Accordingly, when the suction mechanism (exhaust fan 63) is driven, the pressure of the negative pressure chamber 64 becomes the negative pressure, and the medium 6 is sucked and supported by the region A of the downstream side support unit 29 via the upstream side suction hole 81.

That is, the region A of the downstream side support unit 29 where the upstream side suction hole 81 is disposed becomes a region for sucking and supporting the medium 6.

The suction mechanism 65 includes the negative pressure chamber forming member 66 and the exhaust fan 67. The negative pressure chamber forming member 66 forms the negative pressure chamber 68 between the negative pressure chamber forming member 66 and the downstream side support unit 29. The exhaust fan 67 is attached to the negative pressure chamber forming member 66, and discharges the air in the negative pressure chamber 68 to the outside. That is, when the exhaust fan 67 is driven, the air in the negative pressure chamber 68 is discharged to the outside, and the pressure of the negative pressure chamber 68 becomes a negative pressure. Accordingly, when the suction mechanism 65 (exhaust fan 67) is driven, the pressure of the negative pressure chamber 68 becomes the negative pressure, and the medium 6 is sucked and supported by the region C of the downstream side support unit 29 via the downstream side suction hole 82.

That is, the region C of the downstream side support unit 29 where the downstream side suction hole 82 is disposed becomes a region for sucking and supporting the medium 6.

As described above, the suction mechanism is attached to the platen 28, and the platen 28 includes the suction hole communicated with the suction mechanism. The suction mechanisms 61 and 65 described above are disposed separately from the suction mechanism attached to the platen 28. Accordingly, an operation in which the suction mechanism is driven to suck and support the medium 6 on the platen 28 and an operation in which the suction mechanisms 61 and 65 are driven to suck and support the medium 6 on the downstream side support unit 29 via the suction holes 81 and 82 can be respectively controlled.

In the embodiment, in a case of printing on the medium 6, the suction mechanism attached to the platen 28 is driven, and the suction mechanisms 61 and 65 are stopped.

If in a case of printing on the medium 6, both of the suction mechanism attached to the platen 28 and the suction mechanisms 61 and 65 are driven, a load of the transport unit 2 that transports the medium 6 becomes too heavy and there is a possibility that transport failure of the medium 6 and printing trouble due to the transport failure of the medium 6 occur.

In the embodiment, since in the case of printing on the medium 6, the suction mechanism attached to the platen 28 is driven, and the suction mechanisms 61 and 65 are stopped, as compared with the case where both of the suction mechanism attached to the platen 28 and the suction mechanisms 61 and 65 are driven, the load of the transport unit 2 that transports the medium 6 becomes light, and the transport failure of the medium 6 or the printing trouble due to the transport failure of the medium 6 is unlikely to occur.

In other words, in the embodiment, in the case of printing on the medium 6, the medium 6 is sucked and supported via the suction hole (suction hole disposed in the platen 28) disposed on the upstream side in the transport direction F with respect to the cutting position of the medium 6, and is not sucked and supported via the suction holes (suction holes 81 and 82 disposed in the downstream side support unit 29) disposed on the downstream side in the transport direction F with respect to the cutting position of the medium 6. Therefore, an excessive load is unlikely to occur in the transport unit 2, and the printing trouble due to the transport failure of the medium 6 is unlikely to occur.

The downstream side support unit 29 is a component for sucking and supporting the medium 6, and is a component for heating the medium 6. In the downstream side support unit 29, the regions (regions A and C) for sucking and supporting the medium 6, and the region (region B) for heating the medium 6 of the downstream side support unit 29 are respectively disposed.

If in the downstream side support unit 29, in a case where the region for sucking and supporting the medium 6 and the region for heating the medium 6 are the same as each other, that is, in a case where the third heater 73 and the suction holes 81 and 82 are disposed in the same region, since the portion where the suction holes 81 and 82 are disposed is not heated, a portion which hardly heats the medium 6 and a portion which easily heats the medium 6 are generated in the region for heating the medium 6. Therefore, in the downstream side support unit 29, in a case where the region for sucking and supporting the medium 6 and the region for heating the medium 6 are the same as each other, as compared with a case where the region for sucking and supporting the medium 6 and the region for heating the medium 6 are different from each other, the uniformity of the temperature of the region where the medium 6 is heated deteriorates and the uniformity of the temperature of the medium 6 heated by the region heating the medium 6 deteriorates. Therefore, drying unevenness is likely to occur in the ink ejected on the medium 6.

In the embodiment, in the downstream side support unit 29, since the case where the region for sucking and supporting the medium 6 and the region for heating the medium 6 are different from each other, as compared with the case where the region for sucking and supporting the medium 6 and the region for heating the medium 6 are the same as each other, the uniformity of the temperature of the downstream side support unit 29 is enhanced, and the drying unevenness is unlikely to occur in the ink ejected on the medium 6.

Furthermore, between the downstream side support unit 29 and the winding portion 22, the tension applying unit 5 for applying tension to the medium 6 is disposed. The tension applying unit 5 includes a rotatable arm 19 and a tension bar 20 supported by one end of the arm 19 and applying tension to the medium 6. The arm 19 is supported by a rotation shaft 53 disposed on the body frame 10 and is rotatable. The tension bar 20 is rotatably supported at one end portion (tip end portion) of the arm 19.

A sensor portion 90 is attached near the other end portion of the arm 19. The sensor portion 90 includes an upper limit sensor 91, a lower limit sensor 92, and a flag plate 93. The flag plate 93 has a fan shape around the rotation shaft 53 and is attached to the arm 19. The upper limit sensor 91 and the lower limit sensor 92 are so-called transmission type photo sensors, and are attached to the outer peripheral edge portion (circular arc portion) of the flag plate 93.

The tension bar 20 has an axial length longer than the assumed maximum width of the medium 6 and is in contact with the entire region in the width direction (X direction) of the medium 6, and presses the medium 6 to apply tension to the medium 6. As a result, the winding portion 22 can wind up the medium 6 in a state in which tension is applied. When tension is applied to the medium 6, the winding portion 22 can wind up the medium 6 in a normal shape (cylindrical shape) without generating troubles such as wrinkle or slack on the medium 6.

In a case of printing on the medium 6, the tension bar 20 reciprocates (swings) between a position P1 disposed on a lower side (Z (−) direction) and a position P2 disposed on an upper side (Z (+) direction). The position P1 is detected by the lower limit sensor 92, and the position P2 is detected by the upper limit sensor 91.

In a case where printing is not performed on the medium 6, for example, in a case of cutting the medium 6, the tension bar 20 is manually moved to a position P3 disposed in the upper side (Z (+) direction) with respect to the position P2, or to a position P1 disposed on the lower side (Z (−) direction) with respect to the position P2.

The positions P1, P2, and P3 are indicated by broken lines in the drawings.

The tension bar 20 is in contact with the medium 6 between the position P1 and the position P2, and applies tension to the medium 6. The tension bar 20 is not in contact with the medium 6 in the position P3, and does not apply tension to the medium 6.

In a case where the printing unit 3 prints on the medium 6 and the medium 6 is sent out in the transport direction F, the tension bar 20 descends to the lower side (Z (−) direction) due to own weight. When the lower limit sensor 92 detects that the tension bar 20 reaches the position P1, the winding motor of the winding portion 22 is driven, and the medium 6 is wound up around the winding portion 22. Thereafter, the tension bar 20 rises to the upper side (Z (+) direction) by the force applied from the winding motor to the medium 6.

When the upper limit sensor 91 detects that the tension bar 20 reaches the position P2, the winding motor of the winding portion 22 stops. Since the medium 6 is continuously sent out in the transport direction F, the tension bar 20 again descends to the lower side (Z (−) direction) due to own weight.

In this manner, in a case where the printing unit 3 prints on the medium 6, the sensor portion 90 detects the position of the tension bar 20, and the driving and the stopping of the winding motor of the winding portion 22 are controlled. Therefore, the tension bar 20 reciprocates (swings) between the position P1 and the position P2.

In a case where the tension bar 20 is disposed between the position P1 and the position P2, the medium 6 is pressed by the tension bar 20, and has a shape overhanging in the Y(+) direction. Tension applied to the medium 6 from the tension bar 20 is proportional to the shape of the medium 6. For example, when the overhang of the medium 6 in the Y (+) direction increases, tension applied to the medium 6 increases. When the overhang of the medium 6 in the Y (+) direction decreases, tension applied to the medium 6 decreases.

In the embodiment, when the tension bar 20 is disposed at the position P1, as compared with the tension bar 20 is disposed between the position P1 and the position P2, tension applied to the medium 6 is set to be reduced. Furthermore, when the tension bar 20 is disposed at the position P3, tension applied to the medium 6 is further reduced.

In the application, a description of "to move the tension bar so as to reduce tension applied to the medium from the tension applying unit" means to move the tension bar 20 so that the tension bar 20 is disposed at either the position P1 or the position P3.

As illustrated in FIG. 3, the printing apparatus 1 includes the control unit 41 for controlling each portion of the printing apparatus 1. Each portion of the apparatus such as the transport roller pairs 23 and 24, the carriage moving portion 33, the recording head 31, the winding portion 22, and the suction mechanisms 61 and 65 are controlled by the control unit 41.

The control unit 41 is configured to include a control circuit 44, an interface portion (I/F) 42, central processing unit (CPU) 43, and a storage portion 45. The interface portion 42 is a portion for transmitting and receiving data between the external device 46 that handles images of a computer and a digital camera and the printing apparatus 1.

The CPU 43 is an arithmetic processing device for performing the control of the entire printing apparatus 1.

The CPU 43 controls each portion of the apparatus such as the transport roller pairs 23 and 24 for transporting the medium 6 in the transport direction, the carriage moving portion 33 for moving the carriage 32 on which the recording head 31 is mounted in a direction intersecting the transport direction, the recording head 31 for ejecting the ink toward the medium 6, and the winding portion 22 for winding up the medium 6, by the control circuit 44 based on the printing data received from the external device 46.

The CPU 43 controls the driving and the stopping of the suction mechanisms 61 and 65 based on information from the sensor portion 90. Furthermore, icons for driving and stopping the suction mechanisms 61 and 65 are disposed on the operation panel 49. The user can drive and stop the suction mechanism 61 and the suction mechanism 65 via the operation panel 49.

The storage portion 45 is a portion for securing a region for storing the program of the CPU 43 and a work region, and includes a storage element such as a random access memory (RAM), and an electrically erasable programmable read-only memory (EEPROM).

Figure 4:
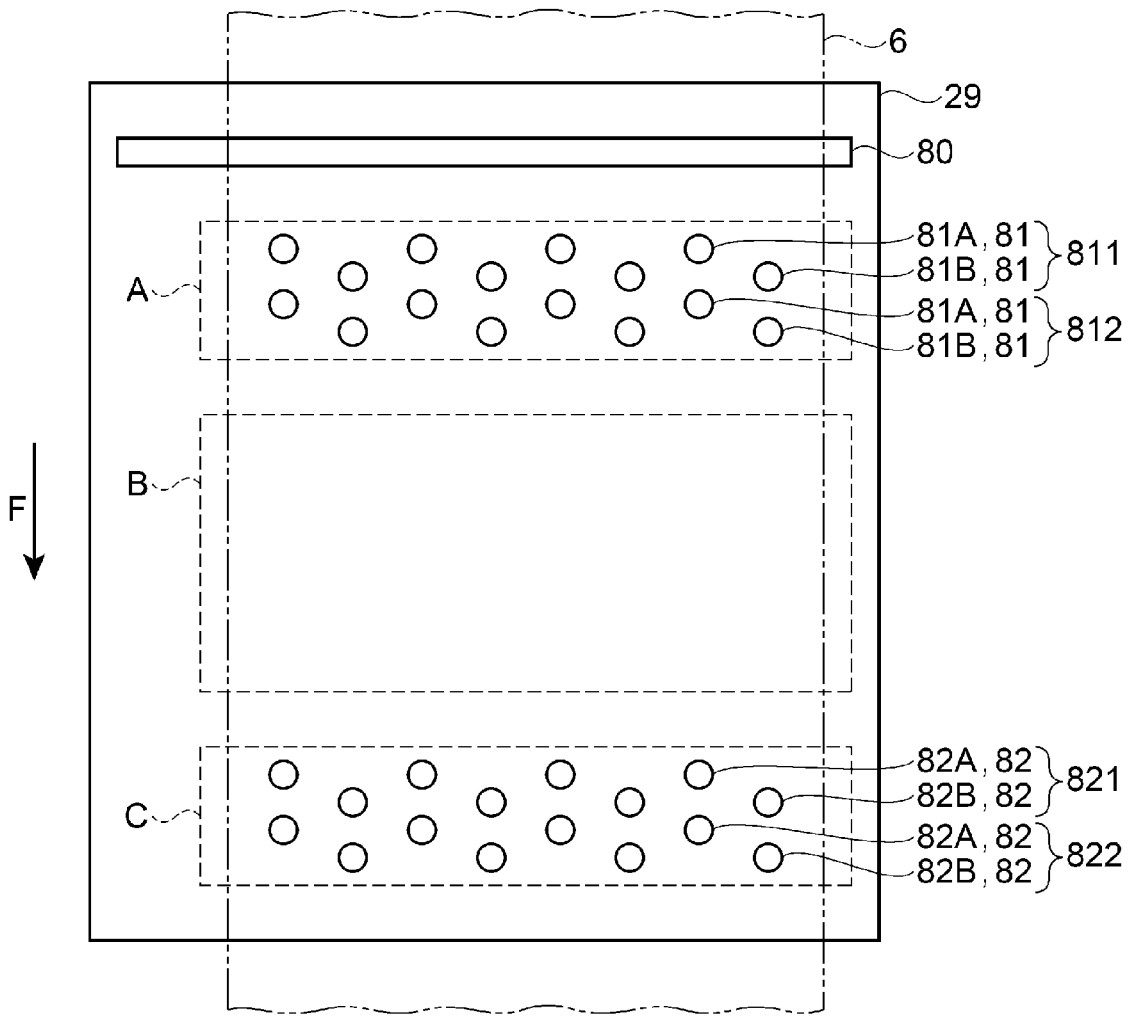
FIG. 4 is a schematic plan view of a downstream side support unit.

FIG. 4 is a schematic plan view of the downstream side support unit. Specifically, FIG. 4 is a schematic plan view in a case where a portion overhanging from the casing portion 14 of the downstream side support unit 29 is viewed from a direction orthogonal to the transport direction F.

Next, a state of the suction holes 81 and 82 disposed in the downstream side support unit 29 will be described with reference to FIG. 4.

As illustrated in FIG. 4, the region A includes two hole columns 811 and 812 disposed in the transport direction F. The hole column 811 is disposed on the upstream side in the transport direction F with respect to the hole column 812.

The hole columns 811 and 812 include the upstream side suction hole 81A, and the upstream side suction hole 81B adjacent to the upstream side suction hole 81A. In the hole columns 811 and 812, the upstream side suction hole 81A and the upstream side suction hole 81B are alternately disposed in a direction intersecting the transport direction F. The position in the direction intersecting the transport direction F of the upstream side suction hole 81A is different from the position in the direction intersecting the transport direction F of the upstream side suction hole 81B. In other words, in the hole columns 811 and 812, the upstream side suction hole 81 is disposed in a zigzag shape.

That is, the downstream side support unit 29 includes the hole columns 811 and 812 in which the upstream side suction hole 81 is disposed in a direction intersecting the transport direction F. In the hole columns 811 and 812, the position of the upstream side suction hole 81A in the transport direction F is different from the position of the upstream side suction hole 81B adjacent to the upstream side suction hole 81A in the transport direction F.

If in a case the position in the direction intersecting the transport direction F of the upstream side suction hole 81A is the same as the position in the direction intersecting the transport direction F of the upstream side suction hole 81B, the upstream side suction hole 81 is disposed in a latticed shape in the hole columns 811 and 812.

In the case the upstream side suction hole 81 is disposed in the zigzag shape, as compared with the case where the upstream side suction hole 81 is disposed in the latticed shape, arrangement density of the upstream side suction holes 81 can be increased and the upstream side suction holes 81 can be uniformly disposed. Accordingly, suction force acting on the medium 6 from the upstream side suction hole 81 in the region A is strengthened, and the downstream side support unit 29 in which the upstream side suction hole 81 is disposed can stably suck and support the medium 6.

The region C includes two hole columns 821 and 822 disposed in the transport direction F. The hole column 821 is dispose on the upstream side in the transport direction F with respect to the hole column 822.

The hole columns 821 and 822 include the downstream side suction hole 82A, and the downstream side suction hole 82B adjacent to the downstream side suction hole 82A. In the hole columns 821 and 822, the downstream side suction hole 82A and the downstream side suction hole 82B are alternately disposed in a direction intersecting the transport direction F. The position in the direction intersecting the transport direction F of the downstream side suction hole 82A is different from the position in the direction intersecting the transport direction F of the downstream side suction hole 82B. In other words, in the hole columns 821 and 822, the downstream side suction hole 82 is disposed in a zigzag shape.

In the case the downstream side suction hole 82 is disposed in the zigzag shape, as compared with the case where the downstream side suction hole 82 is disposed in the latticed shape, arrangement density of the downstream side suction holes 82 can be increased and the downstream side suction holes 82 can be uniformly disposed. Accordingly, suction force acting on the medium 6 from the downstream side suction hole 82 in the region C is strengthened, and the downstream side support unit 29 in which the downstream side suction hole 82 is disposed can stably suck and support the medium 6.

Figure 5:
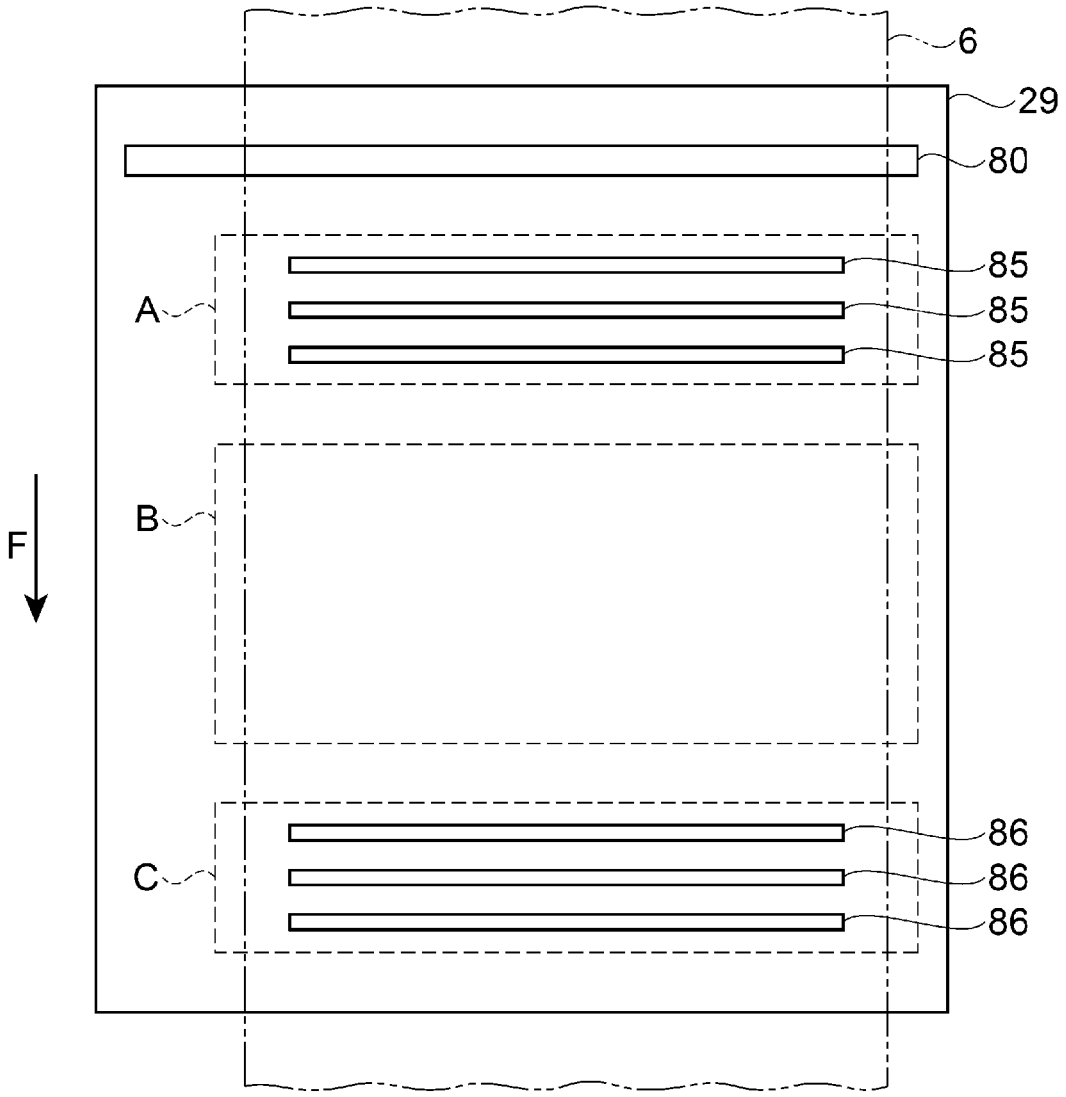
FIG. 5 is a schematic plan view illustrating another embodiment of the downstream side support unit.

FIG. 5 is a schematic plan view illustrating another embodiment of the downstream side support unit.

As illustrated in FIG. 5, three grooves 85 are disposed along the transport direction F in the region A of the downstream side support unit 29. The groove 85 penetrates the downstream side support unit 29, and extends in the direction intersecting the transport direction F. The groove 85 communicates with the suction mechanism 61. When the suction mechanism 61 is driven to set the negative pressure chamber 64 to a negative pressure, the medium 6 is sucked and supported by the region A of the downstream side support unit 29 via the groove 85.

The groove 85 is an example of "opening portion".

Three grooves 86 are disposed along the transport direction F in the region C of the downstream side support unit 29. The groove 86 is the opening portion penetrating the downstream side support unit 29, and has a shape extended in the direction intersecting the transport direction F. The groove 86 communicates with the suction mechanism 65. When the suction mechanism 65 is driven to set the negative pressure chamber 68 to a negative pressure, the medium 6 is sucked and supported by the region C of the downstream side support unit 29 via the groove 86.

The groove 86 is an example of "opening portion".

The grooves 85 and 86 are the opening portions extended in the direction intersecting the transport direction F, for example, the hole columns 811, 812, 821, and 822 described above are opening portions scattered in the direction intersecting the transport direction F. In the opening portions (grooves 85 and 86) extended in the direction intersecting the transport direction F, as compared with the opening portions (hole columns 811, 812, 821, and 822) scattered in the direction intersecting the transport direction F, the opening area in the direction intersecting the transport direction F becomes wide, and the medium 6 can be strongly sucked and supported by the downstream side support unit 29.

The hole columns 811, 812, 821, and 822, and the grooves 85 and 86 described above may be single or plural. In the regions A and C of the downstream side support unit 29, the holes and the grooves may be mixed. That is, the regions A and C of the downstream side support unit 29 may have the opening portion capable of sucking the medium 6. A shape of the opening portion, the number of opening portions, a formation position of the opening portion, and the like are not limited to the embodiment described above.

The printing apparatus 1 is the printing apparatus with the roll-to-roll system. An elongated medium 6 wound up in a roll form is fed out from the feeding portion 21 and printed on the medium 6 in the printing unit 3. When printing on the medium 6 is completed, the medium 6 is cut, and the cut medium 6 is wound up in the roll form around the winding portion 22.

Cutting of the medium 6 is manually performed using the guide portion 80 of the downstream side support unit 29. When the medium 6 is cut, the end portion of the cut medium 6 falls in a gravity direction (Z (−) direction) due to own weight. When the end portion of the medium 6 falls since troubles such as stain and wrinkles occur on the medium 6, the user cuts the medium 6 while pressing the medium 6 by hand, so that the end portion of the medium 6 does not fall. Furthermore, it is necessary for the user to keep pressing the medium 6 by hand so that the end portion of the cut medium 6 does not fall until the medium 6 is wound up around the winding portion 22.

However, when the width of the medium 6 increases, it is difficult for one user to cut the medium 6 while pressing the medium 6 by hand. Therefore, it is preferable that the person who press the medium 6 by hand and the person who cut the medium 6 be separate persons and the medium 6 be cut by the two users. Alternatively, when the medium 6 having a long width is cut by the one user, there are cases in which it is difficult to press the medium 6 by hand, and the end portion of the medium 6 falls. Therefore, there is a possibility that troubles such as stain and wrinkles on the medium 6 occur.

As described above, the printing apparatus 1 has a problem that workability (convenience) in cutting the medium 6 and workability (convenience) in winding up the cut medium 6 are bad.

The printing apparatus 1 according to the embodiment has an excellent configuration to solve such a problem that the workability (convenience) is bad, so the details thereof will be described below.

In the printing apparatus 1, in the case of printing on the medium 6 is completed, the medium 6 is cut, and the cut medium 6 is wound up around the winding portion 22 in accordance with the following procedure. In addition, as described above, in the case of cutting the medium 6 and winding up the cut medium 6 around the winding portion 22, the suction mechanism attached to the platen 28 is stopped.

In the case of cutting the medium 6 and winding up the cut medium 6 around the winding portion 22, the suction mechanism attached to the platen 28 may be driven.

1) In the case of cutting the medium 6, first, the tension bar 20 is moved so that tension applied to the medium 6 is reduced.

For example, in FIG. 2, the tension bar 20 is moved to the upper side (Z (+) direction) so that the tension bar 20 is disposed at the position P3. When the tension bar 20 is disposed at the position P3, the tension bar 20 is not in contact with the medium 6, and tension is not applied to the medium 6 from the tension bar 20.

Alternatively, in FIG. 2, the tension bar 20 may be moved to the lower side (Z (−) direction) so that the tension bar 20 is disposed at the position P1. As described above, when the tension bar 20 is disposed at the position P1, as compared with a case where the tension bar 20 is disposed between the position P1 and the position P2, tension applied to the medium 6 is reduced.

In the embodiment, the movement of the tension bar 20 is manually performed by the user. For example, a motor for moving the tension bar 20 may be disposed and the tension bar 20 may be moved by driving the motor.

2) Next, the suction mechanisms 61 and 65 are driven to suck and support the medium 6 on the downstream side support unit 29 via the suction holes 81 and 82. Specifically, the user drives the suction mechanisms 61 and 65 via the icons disposed on the operation panel 49 to suck and support the medium 6 on the downstream side support unit 29.

3) Next, the user moves the cutting member such as a cutter along the guide portion 80 and cuts the medium 6. Since the medium 6 is sucked and supported by the downstream side support unit 29, the cut medium 6 does not fall to the lower side (Z (−) direction) even if the user does not press the medium 6 by hand. Furthermore, even in a case where the width of the medium 6 is long, since the medium 6 is stably sucked and supported by the downstream side support unit 29 via the suction holes 81 and 82, the user does not need to press the medium 6 by hand, and can concentrate on the work of cutting the medium 6. Even in a case where the width of the medium 6 is long, it is possible for one user to cut the medium 6 while suppressing the trouble that the cut medium 6 falls to the lower side (Z (−) direction). Therefore, it is possible to improve the workability (convenience) in cutting work.

For example, in a case where the tension bar 20 is disposed between the position P1 and the position P2, tension is applied to the medium 6 by the tension bar 20, and the medium 6 is deformed in the Y (+) direction, even when the suction mechanism 61 and the suction mechanism 65 are driven, there is a possibility that it is difficult to suck and support the medium 6 on the downstream side support unit 29. Therefore, when the medium 6 is cut in a state where the tension bar 20 is disposed between the position P1 and the position P2, the medium 6 is not sucked and supported by the downstream side support unit 29, and the cut medium 6 falls to the lower side (Z (−) direction), and there is a possibility that troubles such as wrinkle and stain may occur on the medium 6. Furthermore, the tension bar 20 also falls to the lower side (Z (−) direction) together with the medium 6, and there is a possibility that troubles such as breakdown of the printing apparatus 1 may occur, for example, due to impact caused by falling of the tension bar 20.

When the tension bar 20 is moved so that tension applied to the medium 6 is reduced, the medium 6 can be reliably sucked and supported by the downstream side support unit 29, so that the trouble described above can be suppressed. Accordingly, it is preferable to cut the medium 6 after moving the tension bar 20 so that tension applied to the medium 6 from the tension applying unit 5 be reduced.

In the embodiment, cutting of the medium 6 is manually performed by the user. For example, the cutting member may be attached to the carriage 32 and the cutting member may be configured to be moved together with the carriage 32 in a direction intersecting the transport direction F to cut the medium 6. That is, a configuration may be adopted in which a cutting portion capable of cutting the medium 6 is disposed and the medium 6 is automatically cut by driving the cutting portion.

4) Next, the suction mechanism 61 is stopped and the cut medium 6 is wound up around the winding portion 22 in a state where the suction mechanism 65 is driven. That is, the cut medium 6 is wound up around the winding portion 22 in a state where the medium 6 is sucked and supported by the region C of the downstream side support unit 29 via the downstream side suction hole 82.

If in a case where the upstream side suction hole 81 is disposed in the downstream side support unit 29 and the downstream side suction hole 82 is not disposed, the medium 6 is sucked and supported only in the region A of the downstream side support unit 29. In a case of winding up the medium 6 around the winding portion 22, the end portion of the cut medium 6 moves from the region A toward the region C. When the end portion of the cut medium 6 passes through the region A, since the medium 6 is not sucked and supported by the downstream side support unit 29, there is a possibility that the medium 6 falls to the lower side (Z (−) direction), and troubles such as wrinkle and stain may occur on the medium 6.

In the embodiment, since both of the upstream side suction hole 81 and the downstream side suction hole 82 are disposed in the downstream side support unit 29, the medium 6 is sucked and supported in both of the region A and the region C of the downstream side support unit 29. Therefore, the end portion of the cut medium 6 does not fall to the lower side (Z (−) direction) until the end portion of the cut medium 6 passes through the region C. Furthermore, since the downstream side suction hole 82 (the region C) is disposed close to the winding portion 22, the size (area) of the medium 6 falling to the lower side (Z (−) direction) is reduced, adverse influence due to the medium 6 falling to the lower side (Z (−) direction) can be reduced.

In a state where both of the suction mechanism 61 and the suction mechanism 65 are driven without stopping the suction mechanism 61, the cut medium 6 may be wound up around the winding portion 22.

As described above, the printing apparatus 1 according to the embodiment can obtain the following effects.

1) In a case of printing on the medium 6, the medium 6 is sucked and supported via the suction holes (suction holes disposed in the platen 28) disposed on the upstream side in the transport direction F with respect to the cutting position of the medium 6, and is not sucked and supported via the suction holes (suction holes 81 and 82) disposed on the downstream side in the transport direction F with respect to the cutting position of the medium 6, an excessive load is unlikely to occur in the transport unit 2, and printing trouble caused by transport failure of the medium 6 is unlikely to occur.

2) In the downstream side support unit 29, since a region (region where the suction holes 81 and 82 are disposed) for sucking and support the medium 6, and a region (region where the third heater 73 is disposed) for heating the medium 6 are different from each other, as compared with a case where the area for sucking and supporting the medium 6 and the area for heating the medium 6 are the same as each other, uniformity of the temperature of the area for heating the medium 6 is enhanced, and drying unevenness on the ink ejected on the medium 6 is unlikely to occur.

3) Since the medium 6 is cut in a state of sucking and supporting by the downstream side support unit 29, the cut medium 6 falls in the gravity direction due to own weight, troubles such as wrinkle and stain are unlikely to occur on the cut medium 6.

4) Since the medium 6 is cut in a state where the tension bar 20 is moved so that tension applied to the medium 6 is reduced and the medium 6 is reliably sucked and supported by the downstream side support unit 29, it is possible to reliably suppress trouble that the cut medium 6 falls in the gravity direction due to own weight.

5) Since the medium 6 is wound up around the winding portion 22 in a state where the medium 6 is sucked by the downstream side suction hole 82 disposed close to the winding portion 22, the size (area) of the medium 6 falling in the gravity direction due to own weight is reduced, adverse influence due to the medium 6 falling in the gravity direction due to own weight can be reduced.

6) Since the suction holes 81 and 82 are disposed in the zigzag shape, as compared with a case where the suction holes 81 and 82 are disposed in the latticed shape, the arrangement density of the suction holes 81 and 82 is increased, the suction holes 81 and 82 are uniformly arranged, the suction force acting on the medium 6 is strengthened, and the downstream side support unit 29 disposed with the suction holes 81 and 82 can stably suck and support the medium 6.

The winding portion 22 and the tension applying unit 5 described above are not indispensable components in the application. That is, the printing apparatus according to the application may have the winding portion 22 and the tension applying unit 5, and may not have the winding portion 22 and the tension applying unit 5. Furthermore, the medium 6 according to the application may have a configuration in which the medium 6 is wound up in roll shape around the roll body, or may be a cut sheet (configuration separated for each one sheet).

Furthermore, it is not limited to a configuration in which the suction mechanisms 61 and 65 are separately disposed, and a configuration in which the upstream side suction holes 81 and the downstream side suction hole 82 are simultaneously sucked by one suction mechanism may be adopted.

This application claims priority under 35 U.S.C. § 119 to Japanese Patent Application No. 2016-038651, filed Mar. 1, 2016. The entire disclosure of Japanese Patent Application No. 2016-038651 is hereby incorporated herein by reference.

What is claimed is:

1. A printing apparatus comprising:

a printing unit that prints on a medium a medium support unit that is disposed on a downstream side in a transport direction of the medium with respect to the printing unit, and includes an opening portion which is communicated with a suction mechanism and a cutter guide portion upstream of the opening portion, the cutter guide portion defining a cutting position for the medium;

a winding portion that is disposed on a downstream side with respect to the medium support unit, and that is configured to wind up the medium;

and a controller configured to drive the suction mechanism, wherein in a case of cutting the medium at the cutter guide portion, the suction mechanism is driven so that the cut medium is sucked and supported by the medium support unit via the opening portion, wherein, when the cut medium is wound up around the winding portion, the suction mechanism is driven so that the medium is sucked and supported by the medium support unit via the opening portion, and wherein the opening portion penetrates the medium support unit, and is a groove that extends in a direction intersecting the transport direction.

2. The printing apparatus according to claim 1 further comprising:

a tension applying unit that is disposed between the medium support unit and the winding portion, wherein the tension applying unit includes a tension bar that applies tension to the medium, and wherein, when the medium is cut, the tension bar is moved so that tension applied from the tension bar is reduced.

3. The printing apparatus according to claim 1, further comprising:

a heater that heats the medium, wherein the opening portion is disposed on an upstream side in the transport direction of the medium with respect to a region for heating in the medium support unit, the medium being heated by the heater in the region for heating.

4. The printing apparatus according to claim 1, further comprising:

a heater that heats the medium, wherein the opening portion is disposed on the downstream side with respect to a region for heating in the medium support unit, the medium being heated by the heater in the region for heating.

5. The printing apparatus according to claim 1, further comprising:

a heater that heats the medium, wherein the cut medium is sucked so that the cut medium is on a region for heating in the medium support unit, the medium being heated by the heater in the region for heating.

6. A control method for a printing apparatus including a printing unit that prints on a medium, a medium support unit including an opening portion that communicates with a suction mechanism and a cutter guide portion, and a winding portion, the method comprising:

printing on the medium by the printing unit;

cutting the medium after printing on the medium;

winding up the cut medium around the winding portion; and driving the suction mechanism so that the cut medium is sucked via the opening portion and supported by the medium support unit when the cut medium is being wound up.

* * * * *